United States Patent [19]

Kern

[11] 4,387,545

[45] Jun. 14, 1983

[54] PANEL ASSEMBLY AND A METHOD OF CONSTRUCTING SAID ASSEMBLY

[76] Inventor: John T. Kern, The Grange, Budworth Rd., Noctorum, Birkenhead, Merseyside, L43 9TL, England

[21] Appl. No.: 171,650

[22] Filed: Jul. 23, 1980

[30] Foreign Application Priority Data

Jul. 26, 1979 [GB] United Kingdom ..... 7926021

[51] Int. Cl.[3] ..... E06B 3/70

[52] U.S. Cl. ..... 52/455

[58] Field of Search ..... 52/475, 476, 455–457, 52/202, 656

[56] References Cited

U.S. PATENT DOCUMENTS 579,696 3/1897 Carter ..... 52/455

2,003,982 6/1935 Swanson ..... 52/202

*Primary Examiner*—James L. Ridgill, Jr.

*Attorney, Agent, or Firm*—Gipple & Hale

[57] ABSTRACT

The present invention relates to a panel assembly for use as a door or as a section of a wall and provides a preformed fixed frame accurately defining an aperture for an in-fill panel. The fixed frame is located in a main framework which is constructed around the fixed frame. Subsequently selected in-fill panel or panels can be located in the fixed frame and completion frames are used to secure the in-fill panels in the fixed frame to complete the door or wall section.

10 Claims, 3 Drawing Figures

PANEL ASSEMBLY AND A METHOD OF CONSTRUCTING SAID ASSEMBLY

DESCRIPTION

The present invention relates to a panel assembly for use as a door or as a section of a wall, and a method of constructing such an assembly.

In particular the present invention relates to a panel assembly for use, for example, as wall or cupboard panelling, or panelled doors whether for a wall aperture, a cupboard or for a garage and, especially, to such an assembly that is sold incomplete and is intended to be completed by the purchaser to form a panelled door.

With known constructions of panel assembly, the manufacturer, if he is to offer his customers the opportunity of choosing from the wide range available of in-fill panels including glass or glass substitutes, must, of necessity, leave the customers with the task of selecting and fitting the in-fill panels. However the task of cutting and mitreing the beading which needs to be placed at the juncture of the panel with the frame stiles and rails, is onerous and could dissuade many people from buying such an incomplete panel assembly. If the manufacturer attempts to avoid this problem, by offering the completed panel assembly, he must limit the range of in-fill panels, and the size and other design feature variations, he can offer, in order to avoid an insupportable variety of stock. Further, the completed structure, in relation to the assembly to be completed by the customer, is unduly costly due to the method of beading employed and the requirements of stock control.

For convenience, the description will be given hereinafter with reference to a panelled door as being typical of the structures the present invention is concerned with.

In conventional door assemblies, the frame members i.e. the stiles and the rails usually have the joints preformed and the frame members are assembled together possibly in a jig and, because of the compression necessarily applied to the frame members during assembly and because of inexactitudes in dimensions which are difficult to avoid with wood joints, the apertures produced for the in-fill panels tend not to be precisely rectangular, and also to differ in dimensions from assembly to assembly notwithstanding the fact that the assemblies are intended to be identical. Thus, it might be said of the conventional assemblies, that the basic idea is simply that of forming the framework and that, because of the nature of the frame members, the result produced in respect of the dimensions of the panel apertures is a purely consequential and fortuitous thing viz:-this basic idea could be expressed in the words:-"create the framework first, the apertures follow". It is then left to the final beading to take up the tolerances in the assembled framework. It follows from this, that beading cannot be pre-cut unless it is done specifically for each aperture to be panelled.

According to the present invention there is provided a panel assembly for use as a door or as a section of a wall, comprising a main framework formed from interconnected elongate framework members and a fixed frame formed by four integrally interconnected elongate members to define a rectangular or square aperture, the fixed frame having laterally projecting means for engaging in receiving means in the elongate framework members to thus secure the fixed frame within the main framework, an in-fill panel being secured across said aperture between said fixed frame and a completion frame.

According to a further aspect of the present invention there is provided a method of forming a panel assembly for use as a door or as a section of a wall, comprising the steps of producing a fixed frame formed by four integrally interconnected elongate members to define a rectangular or square aperture, said members having laterally projecting means, locating said fixed frame between two elongate framework members of a main framework with said laterally projecting means engaging in receiving means in said framework members, further elongate framework members of the main framework being engaged with said fixed frame to secure the fixed frame in the main framework, locating an in-fill panel across said aperture and securing a completion frame to said fixed frame to retain the in-fill panel in position between said frames.

The present invention is thus based on a very different idea from the prior art. Figuratively speaking, it is to define the aperture first and then build the framework round it. Being given that, in physical reality, the aperture is defined by a substantially rigid and precisely dimensioned frame providing the bending integrally therewith, then the panel apertures must be precisely formed; and no difficulties arise for the customer in beading the in-fill panel concerned. The frame is a two-part one, each part being a component frame. One part (hereinbefore and hereinafter called for convenience the fixed frame) is assembled with the door stiles and rails. The other part of the frame (hereinbefore and hereinafter called for convenience the completion frame) is supplied with the assembled framework and fixed frame for later application to the door.

The customer chooses whichever in-fill panel he wishes, but to the requisite size, fits it in the fixed frame, which is formed to allow the in-fill panel to lie in the plane it would normally occupy in a panel door, and then fastens the completion frame in place; the latter and the fixed frame being designed to allow them to be secured together with the panel in place. The two frames on their outer aspects present integrally formed beading and thus when the completion frame is fixed in place, the result is indistinguishable from a conventional panel door in which the beading has to be cut precisely to length for each of the apertures of each particular door.

The completion frame is preferably formed of four integrally interconnected members as per the fixed frame. However, alternatively the completion frame may be formed only when four individual beaded members have been secured to the fixed frame to retain the in-fill panel.

While hereabove the fixed frame, completion frame and in-fill panel are separate components, it is conceivable that the in-fill panel may be integrally formed with one or other of the fixed frame and completion frame, or both.

The present invention can thus provide an accurately dimensioned panel assembly e.g. door, the height and width of the door being determined by the accurately produced fixed frame and the dimensions of the stiles and rails. Additionally the fixed frame, due to its integral construction adds strength to the door, absorbing at least a large part of stresses which would normally be passed on to the in-fill panels.

The present invention will now be further described, by way of example, with reference to the accompanying drawings, in which.

Figure 2:
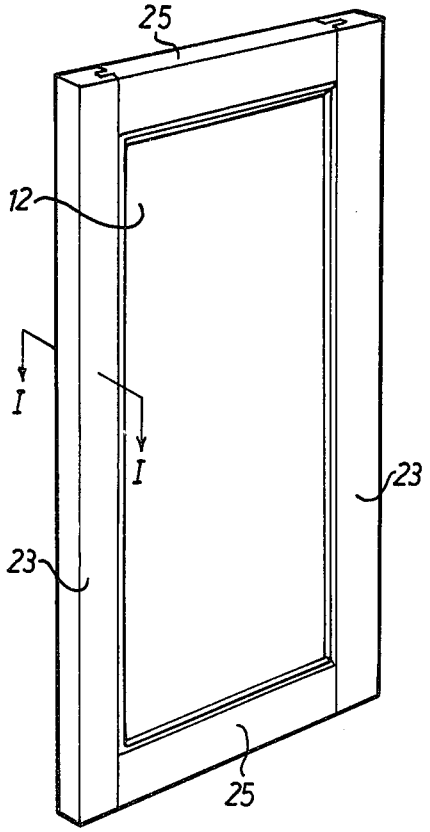
FIG. 2 is a perspective view of the completed assembly of FIG. 1.
Figure 3:
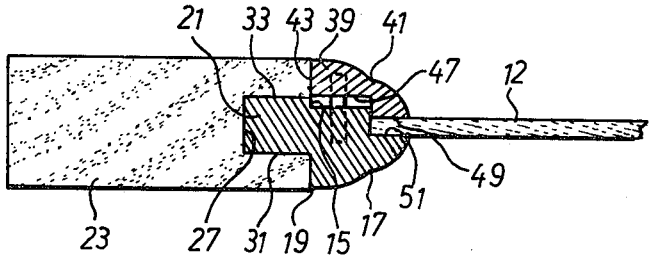
FIG. 3 is a cross-sectional view along lines I—I in FIG. 2.

Referring to the drawings, the component frame 1 shown in FIGS. 1, 2 and 3 constitutes a fixed frame as referred to hereinabove. It consists of four members, 3, 5, 7 and 9 integrally formed to constitute a four sided frame defining a rectangular aperture 11. On its rear aspect, the frame is formed with a shoulder 13 defining a rectangular rebate or recess 13' to receive the marginal edge portions of an in-fill panel 12. The component frame 1 is also formed on its rear aspect with a second shoulder 15 defining a second rectangular rebate or recess 15' the purpose of which will be made evident below.

On its front aspect, the component frame 1 presents a beading 17 which may be of any chosen design, the beading being delimited at its outer edge by a shoulder 19 formed short of the edge of the component frame to leave a margin forming laterally projecting means in the form of a peripheral flange 21.

Figure 1:
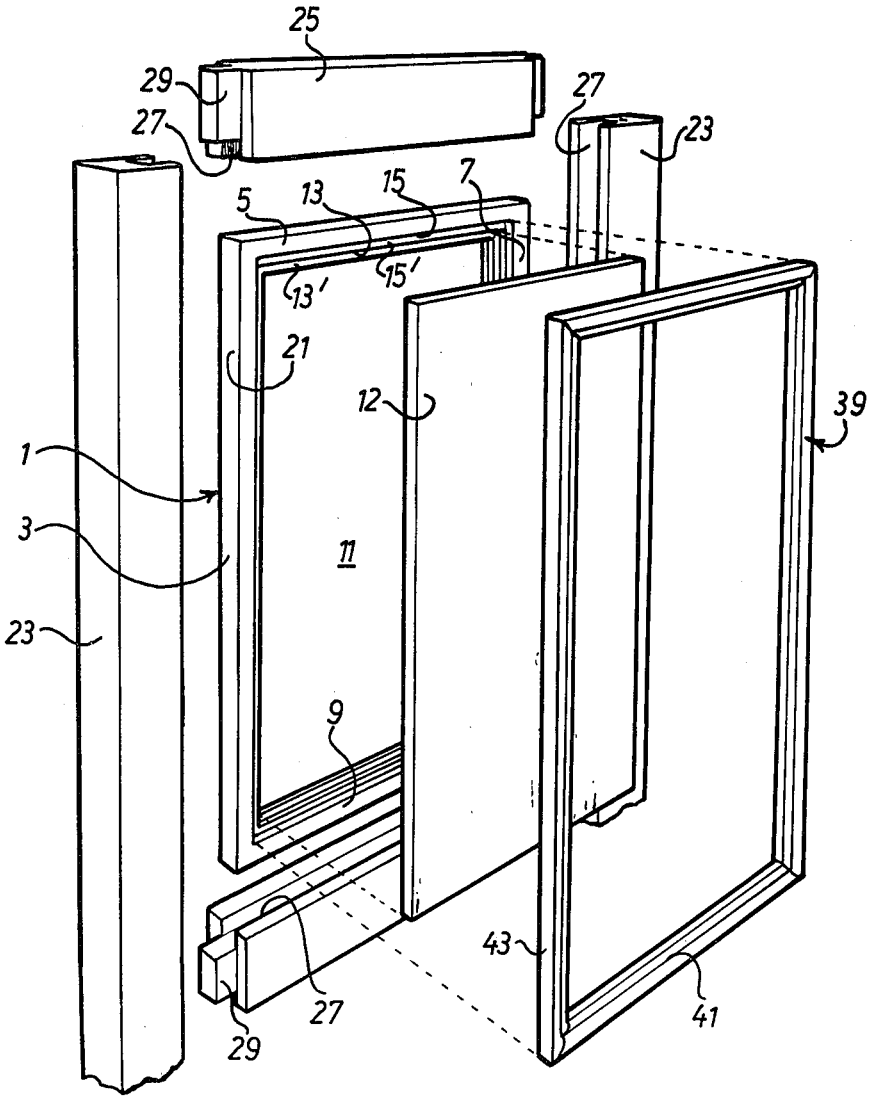
FIG. 1 is an exploded perspective view of one embodiment of a panel assembly according to the present invention.

Referring now to FIG. 1, the door stiles 23 and rails 25 are formed receiving means in the form of longitudinal slots 27; any rails used intermediate the top and bottom of the door being formed with such a groove in each lateral edge. The rails also have jointing tongues 29 at each end thereof.

In assembling the doorframe structure, the stiles are held in a suitable jig and the frame 1 is entered between the stiles by sliding lateral portions 31,33 of the flange 21 in and along the grooves of the stiles. A rail being either the top or bottom one is then entered by entering the tongues 29 of the rail in the respective grooves of the stiles. From the end of the stiles remote from that at which the above-mentioned rail is positioned, a further rail is similarly entered. In the case where the door has only one panel, this rail will be the other end rail, but if the door has more than one panel in its height, this rail will be an intermediate one. In the latter case, one or more further components frame 1 and further rails would be entered as need be. The members of the main framework thus formed are secured together in any convenient manner to form a rigid structure, e.g. by glueing.

The second component frame 39 constitutes a completion frame as referred to hereinabove. The four members of the component frame 39 are integrally formed; and the frame on its front aspect presents a beading 41 identical to that of component frame 1. The component frame 39 in overall dimensions is slightly less than the beading of component frame 1 so that its end edge 43 nearly corresponds to the edge 45 of shoulder 19 of frame 1; and consequently the recess defined by shoulder 15 of the latter frame is dimensioned to be able to receive component frame 39 therein with a slight clearance. On its rear aspect, component frame 39 is formed with a peripheral rebate 47, so that the surface 49 inwardly of the rebate, when frame 39 is fitted in the recess defined by shoulder 15, is spaced from the facing surface 51 of component frame 1 by the distance required to receive a panel of a minimum thickness to be used with the door, usually 1 mm. If the panel thickness is greater than the minimum, then component frame 39 will be lifted partly or wholely from the recess defined by shoulder 15 although this will not be apparent in the finished door.

The rearwardly directed face of the recess 15' of component frame 1 has formed thereon dowel pegs (not shown) and the rearwardly directed face of rebate 47 of component frame 39 is formed with corresponding sockets to receive the dowel pegs or conversely the component frame 1 provides the holes and the component frame 39 the dowel pegs.

Thus, when a panel has been fitted in component frame 1, the component frame 39 is then secured to the component frame 1 by the dowels. Glazing pins could be used but less conveniently and although adhesive could alternatively be used, neither is recommended since both may make it difficult to separate component frames 1 and 39 should the need arise i.e. if it should be decided to install a fresh in-fill panel.

Figure 4:
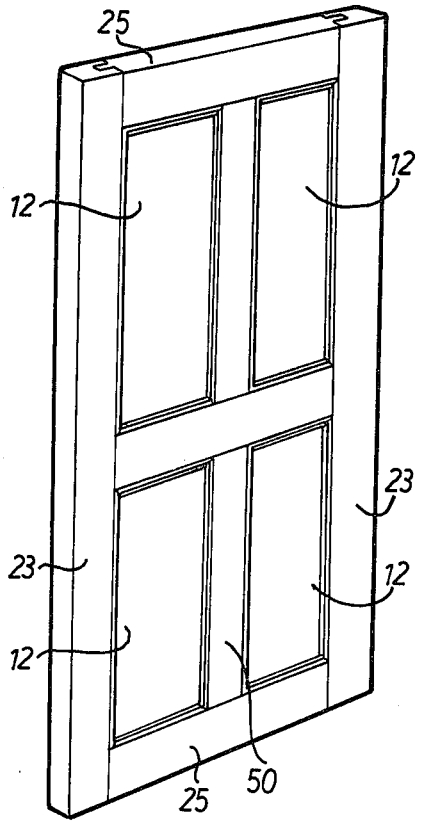
FIG. 4 is a perspective view of a multi-panelled assembly in the form of a door constructed according to the present invention.

The illustrated assembly permits considerable variation in design. For instance, if two in-fill panels (12) (see FIG. 4) are required across the width of the door, the only additional element needed would be a center stile (50) i.e. an intermediate framework member, formed with a groove in each lateral edge; and many variations in the number and size of panels in the height of the door can be achieved with a small number of panel sizes. Further, the illustrated assembly permits the purchaser to use any panel design or material whatsoever of his choice without requiring him to apply beading per se.

The component frames 1 and 39 are preferably moulded of a dimensionally stable plastic material; the material that has become known as "structural foam" being especially preferred. This material has adequate structural strength and also can be moulded with adequate precision of dimensions of the finished moulding. Alternatively, cast metal or jig formed metal could be used; and the stiles and rails could also be formed of metal e.g. aluminium or of plastic material.

No difficulties arise in providing rails with a requisite precision of length since existing machinery is capable of doing this.

In a modification of the invention, the completion frame is integrally formed with an in-fill panel and may be applied to the fixed frame to offer the customer a completed door.

Similarly, in another modification, the fixed frame is formed with an integral panel, and in a still further modification, the two frames are integrally formed as a single structure with an integral in-fill panel.

It will be understood, however, that in these modifications, the basic method of assembling the frame assembly remains the same.

Since the fixed frame makes it possible to define a panel aperture accurately, the present invention may also be viewed as providing a method of constructing the door frame assembly i.e. by using stiles and rails formed with lateral slots as above described and assembling them together with the fixed frame. This has the advantage that the joints of the rails and stiles do not have to be formed at some predetermined location as is the case with a conventional assembly since the fixed frame itself determines the positioning of the rails and stiles. Thus, no inaccuracies can arise due to any inaccuracy of location of the joints between the stiles and rails.

This implies that the framework assembly formed with the fixed frame could utilize a completion frame supplied as individual pre-cut lengths of beading for the customer to apply, or the customer could even be left to cut and apply his own beading since, for any given aperture size the lengths to be cut would not have to be measured for each aperture, in that, the aperture size is accurately defined. It would, therefore, simply be a question of cutting beading to lengths accurately known beforehand, and this is relatively easy. The fact that commercially there may be no advantage in doing this does not detract from the fact that the present invention provides a method of constructing the framework assembly, which does not necessarily entail the provision of integral beading.

The use of the fixed frame also permits "post panelling" i.e. panelling of the door by the customer; and, in doing this, it permits the customer to select and install any panel he wishes, in any desired arrangement.

However, the use of an integrally formed completion frame does give rise to the additional advantages that the manufacturer no longer has any problem of providing beading lengths accurately to fit an aperture, and that the customer is relieved entirely of the need to cut or apply individual lengths of beading per se.

Thus, in this aspect of the invention, not only is manufacture of the assembly simplified but the problems associated with providing the assembly for completion by the customer are overcome.

Additionally the present invention provides for the accurate dimensining of the panel assembly e.g. door, the height and width of the door being solely determined by the accurately dimensioned fixed frame or frames and the dimensions of the stiles and rails. Further, the integral construction of the fixed frames strengthens the complete assembly.

I claim:

1. A panel assembly for use as a door or as a section of a planar surface, comprising a plurality of previously formed fixed frames, each fixed frame comprising for integrally interconnected elongate side member which define a beading on an outer surface, an exact rectangular exterior configuration, a rectangular aperture and a plurality of fastener apertures, a main framework formed around said fixed frames, said main framework comprising a plurality of grooved elongated framework members, said fixed frames being provided with flange means adapted to seat in a groove of said elongated framework members, a plurality of cross members, each of said cross members being formed with tongue means adapted to fit into a respective groove of an opposing elongated framework member and defining at least one groove cut therein adapted to receive and hold said flange means of at least one of said fixed frames the prior exact configuration of the fixed frames aiding in the exact construction of the panel assembly, a panel member adapted to be mounted to each of said fixed frames covering said rectangular aperture, a completion frame adapted to be positioned opposite each said fixed frame, said completion frame defining a plurality of apertures which are adapted to be aligned with the fastener apertures of said fixed frame, and fastener means adapted to extend through said completion frame apertures and said fixed frame fastener apertures to hold said panel member in a stationary position therebetween.

2. A panel assembly according to claim 1, wherein said fixed frame is made of a plastic material.

3. A panel assembly as claimed in claim 1 wherein said fastener means comprises dowel pegs.

4. A panel assembly according to claim 1, wherein each said fixed frame has a recess around its inner perimeter within which the in-fill panel is located.

5. A panel assembly according to claim 1, wherein each said fixed frame and associated in-fill panel are integrally formed together.

6. A panel assembly according to claim 5, wherein the fixed frame, completion frame, and in-fill panel are integrally formed together.

7. A panel assembly according to claim 1, formed as a door, the main framework of the door being formed of stiles and rails, a fixed frame being secured between adjacent rails.

8. A panel assembly according to claim 7, wherein fixed frames are located side-by-side between two adjacent rails, with an intermediate elongate framework member located therebetween.

9. A component panel assembly comprising in combination a disassembled framework, said framework comprising a plurality of stiles and rails, each of said stiles defining a groove and each of said rails defining at least one groove and a tongue on opposite ends adapted to fit into the groove of an adjacent stiles, at least one fixed panel frame, each said panel frame comprising an integrally preformed structure forming a rectangular outer configuration and defining an aperture, each said panel frame being provided with tongue means adapted to mate with and fit into the grooves of said stiles and rails and be held therein, each said panel frame additionally defining a plurality of stepped planar shoulders, one of which is adjacent said aperture, a panel member configured to cover said aperture and be seated on one of said planar shoulders, a component frame adapted to be secured to said panel frame and overlap the outer edge of said panel member and hold it together in a fixed relationship with said fixed panel frame and removable fastener means to fasten said panel frame to said component frame.

10. A method of forming a panel assembly comprising the steps of:

(a) positioning a plurality of stiles parallel to each other, each of said stiles defining a groove therein so that the grooves of the stiles face each other;

(b) placing an integrally constructed panel frame defining a plurality of stepped shoulders and an aperture between said stiles;

(c) inserting the shoulder of said panel frame into groove of the stile opposite it;

(d) placing a plurality of grooved rails formed with tongues at each end between said stiles;

(e) inserting the ends of said grooved rails into said stiles so that the tongue of each end mates with the stile groove opposite it;

(f) placing a panel member on said frame seated on one of said stepped shoulders to cover said aperture of said panel frame;

(g) positioning a component frame over said panel member; and (h) fastening said component frame to said panel frame with fastening means holding said panel member in a fixed position.

* * * * *